United States Patent [19]

Shiratori et al.

[11] Patent Number: 5,035,449

[45] Date of Patent: Jul. 30, 1991

[54] LOCK DEVICE FOR DOOR OF CARGO ROOM OF VEHICLE

[75] Inventors: Naoki Shiratori, Yamanashi; Yoshiaki Ueda, Hiratsuka; Isami Mitobe, Yokohama, all of Japan

[73] Assignees: Mitsui Kinzoku Kogyo Kabushiki Kaisha; Isuzu Motors Limited, both of Tokyo, Japan

[21] Appl. No.: 484,723

[22] Filed: Feb. 22, 1990

[30] Foreign Application Priority Data

Feb. 22, 1989 [JP] Japan ..... 1-42569

[51] Int. Cl.[5] ..... E05C 3/06

[52] U.S. Cl. ..... 292/48; 292/DIG. 21; 292/DIG. 29; 292/DIG. 43; 296/106

[58] Field of Search ..... 292/48, 52, DIG. 29, 292/DIG. 21, DIG. 43; 296/106

[56] References Cited

U.S. PATENT DOCUMENTS 2,926,943 3/1960 Leslie et al. ..... 292/DIG. 29 X
2,992,032 7/1961 Griswold, Jr. et al. .... 292/DIG. 29 X
4,157,844 6/1979 Sarosy et al. ..... 292/DIG. 43 X

FOREIGN PATENT DOCUMENTS 590515 1/1960 Canada ..... 292/48
64-1882 1/1989 Japan .

*Primary Examiner*—Lloyd A. Gall
*Attorney, Agent, or Firm*—Browdy and Neimark

[57] ABSTRACT

A lock device of a door for a cargo room of a wagon type vehicle includes a main lock member disposed at the upper edge of a lower door and having a latch and a ratchet for preventing the reverse rotation of the latch; a main striker disposed at the lower edge of the upper door and engaging with the main lock member; side lock members disposed on both right and left sides of the lower side door; two side strikers engaging with the side lock members; a key operation member disposed on the outer surface of the lower door and releasing the engagement between the main lock member and the main striker; and a door opening handle disposed on the outer surface of the lower door and releasing the engagement between the side lock members and the side strikers. The latch of the main lock member is fixed by a first horizontal shaft which is in parallel with the direction of width of the car body, the ratchet of the main lock member is fixed by a second horizontal shaft which is in parallel with the first horizontal shaft and the main striker is fitted to the upper door under the state where it is in parallel with the direction of width of the car body.

2 Claims, 5 Drawing Sheets

LOCK DEVICE FOR DOOR OF CARGO ROOM OF VEHICLE

BACKGROUND OF THE INVENTION

This invention relates to a lock device for a door of a vehicle, and more particularly to a lock device for a door of a cargo room of a wagon type vehicle which consists of an upper door and a lower door.

DESCRIPTION OF THE PRIOR ART

Japanese Patent Laid-Open No. 1882/1989 as a prior art reference discloses a door lock device for a vehicle which includes an upper door disposed on the rear surface of a car body and fitted pivotally at its upper edge to the car body; a lower door disposed on the rear surface of the car body and fitted pivotally at its lower edge to the car body; a main lock member disposed at the upper edge of the lower door and having a latch and a ratchet for preventing the reverse rotation of the latch; a main striker disposed at the lower edge of the upper door and engaging with the main lock member; a pair of side lock members disposed on both right and left sides of the lower door; a pair of side strikers fixed to the car body and engaging with the side lock members, respectively; a key operation portion disposed on the outer surface of the lower door for releasing the engagement between the main lock member and the main striker; and a door opening handle disposed on the outer surface of the lower door for releasing the engagement between the side lock members and the side strikers.

The latch of the main lock member is rotatably fitted by a longitudinal shaft having an axis which is in parallel with the vertical direction of the car body and the main striker is fitted to the upper door under the parallel state to the vertical direction of the car body.

If the latch is fitted by the longitudinal shaft which is in parallel with the vertical direction of the car body as in the prior art reference described above, the main striker, too, becomes naturally in parallel with the vertical direction of the car body. If fitting is made in this manner, however, the movement of the upper door in the longitudinal direction can be limited strongly, but its movement in the vertical direction can be hardly limited. Therefore, this mechanism is not suitable as the lock device for the upper door which rotates in the vertical direction.

SUMMARY OF THE INVENTION

It is therefore an object of the present invention to provide a lock device for eliminating the drawback described above wherein the latch of the main lock member is fitted by a horizontal shaft parallel to the direction of width of the car body and the main striker is fitted to the upper door under the parallel state to the direction of width of the car body.

DESCRIPTION OF THE PREFERRED EMBODIMENT

Hereinafter, an embodiment of the present invention will be described with reference to the drawings. A rear door 2 of a cargo room disposed on the rear surface of a car body 1 of a wagon type vehicle includes an upper door 3 and a lower door 4. The upper door 3 is made of glass and its upper edge is pivotally fitted to the car body 1 by hinges. The lower door 4 is made of a metal and its lower edge is pivotally fitted to the car body 1 by hinges.

Figure 1:
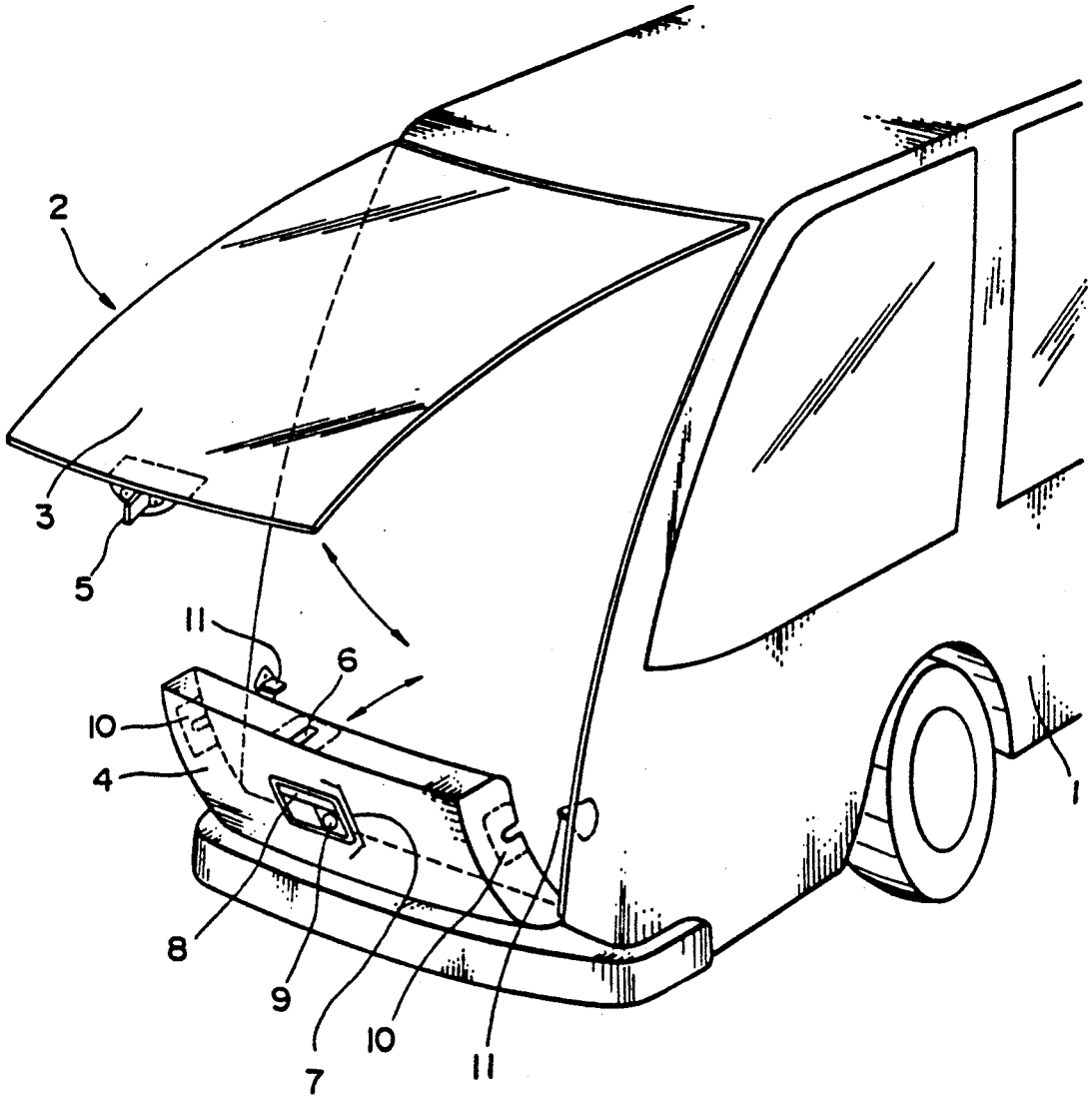
FIG. 1 is a perspective view of a lock device of the present invention when fitted to a wagon type vehicle.

A U-shaped main striker 5 is fixed to the center of the lower edge of the upper door 3 in the transverse direction and a main lock member 6 engaging with the main striker 5 is fitted to the center of the upper edge o the lower door 4 in the transverse direction. FIG. 1 shows an overall relationship of disposition. Therefore, the shapes of the main striker 5 and main lock member 6 are somewhat different from the later-appearing shapes. Side lock members 10 engaging with side strikers 11, which are fixed to the car body 1, are disposed on both sides of the lower door 4.

An operation member 7 is disposed on the outer surface of the lower door 4. This operation member 7 includes a key operation portion 9 for opening the upper door 3 and a door opening handle 8 for opening the lower door 4. The key operation portion 9 has a key cylinder. The key operation portion 9 includes the type wherein when the key is inserted into the key cylinder to rotate it, the rotation is transmitted to the main lock member, and the type wherein when the key cylinder is rotated and then pushed into, this movement is transmitted to the main lock member 6. The door opening handle 8 is constituted in such a manner that it is inoperative unless the upper door 3 is opened by the key operation portion 9. Therefore, the key cylinder exhibits the locking function of the rear door 2 as a whole. The door opening and closing operations can be made at the same position outside the car body and maneuverability can be improved by disposing the operation portions of the upper and lower doors 3, 4 on the outer surface of the lower door 4.

Next, the construction of the main lock member 6 will be described in detail.

Figure 2:
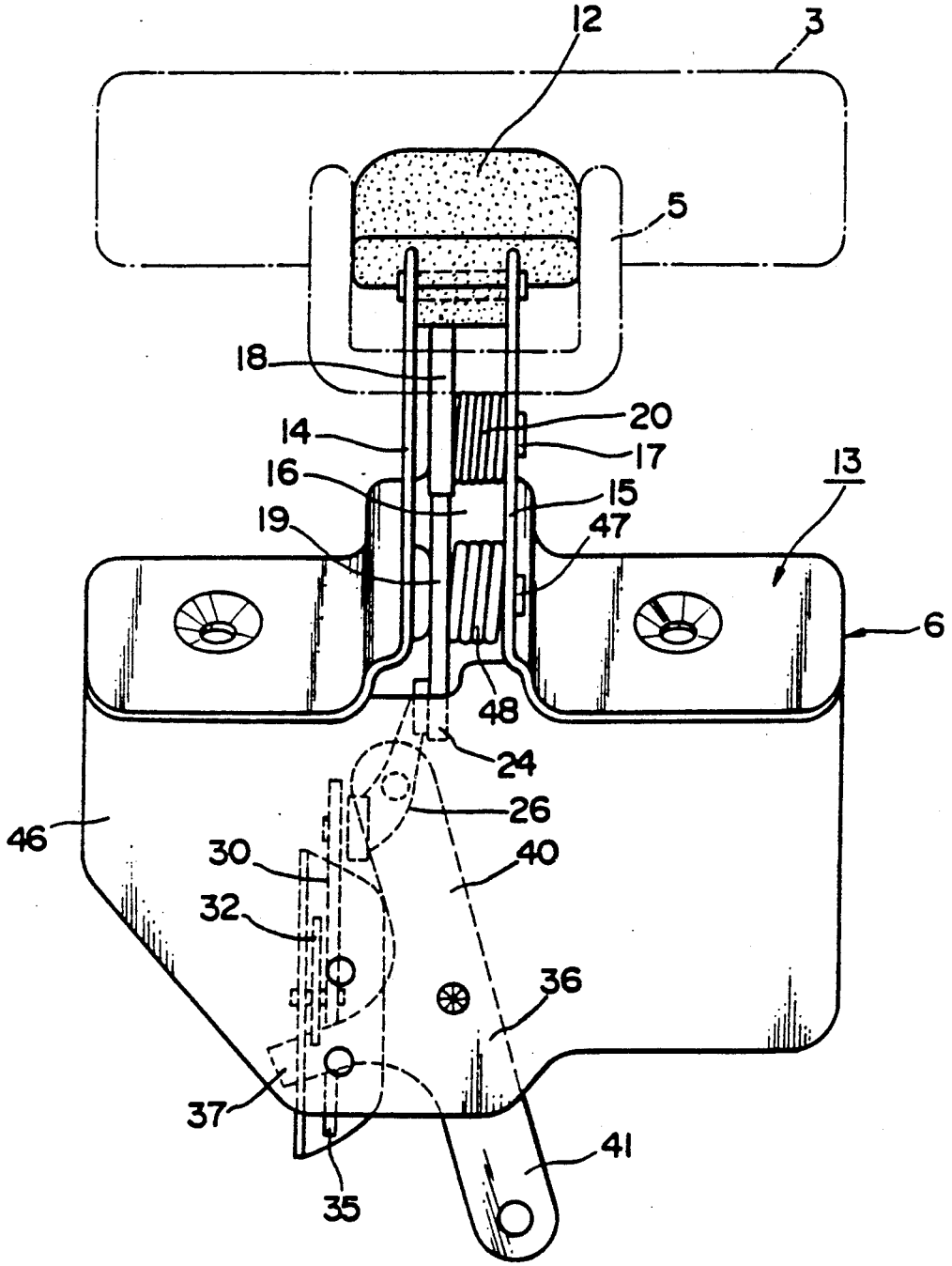
FIG. 2 is a front view of a main lock member viewed from the indoor side.

FIG. 2 is a front view of the main lock member 6 when viewed from the indoor side. It is fitted to the lower door 4 with a rubber member 12 positioned upward. The rubber member 12 is disposed in order to prevent accidental injury of the hand of the driver and to prevent accidental breakage of cargoes.

A fitting metal 13 is disposed for the purpose of assembly of the main lock member and its fitting. The fitting metal 13 consists of a left metal 14, a right metal 15 and a lower metal 46. The left and right metals 14, 15 have a mutually symmetric L-shape as shown in FIG. 2 and define a gap 16 between them. A latch 18 and a ratchet 19 are rotatably fitted within the gap 16 by a horizontal shaft 17 and a transverse shaft 47 which is parallel to the shaft 17, respectively. The axis of each horizontal shaft 17, 47 extends in the transverse direction of the car body 1. Therefore, the main striker 5 meshing with the latch 18 extends horizontally in parallel with the upper door 3 as shown in FIG. 2. Reference numerals 20 and 48 represent return springs for the latch 18 and the ratchet 19.

Whether the latch 18 is fitted by the horizontal shaft 17 or by a vertical shaft having its axis in the vertical direction of the car body 1 is very important from the functional aspect. In other words, if the latch 18 is fitted by the horizontal shaft 17, the main striker 5 can be fitted under the horizontal state to the upper door 3 as described above but when the main latch 18 is fitted by the vertical shaft, the striker lies vertically in parallel with the vertical direction of the car body 1. If the main striker 5 lies vertically, it can limit strongly the longitudinal movement of the upper door but can hardly limit its vertical movement. Therefore, it is not suitable for the lock device of the upper door which rotates in the vertical direction. If the main striker 5 is fitted horizontally, however, it can strongly hold the upper door 3 rotating in the vertical direction.

Figure 3:
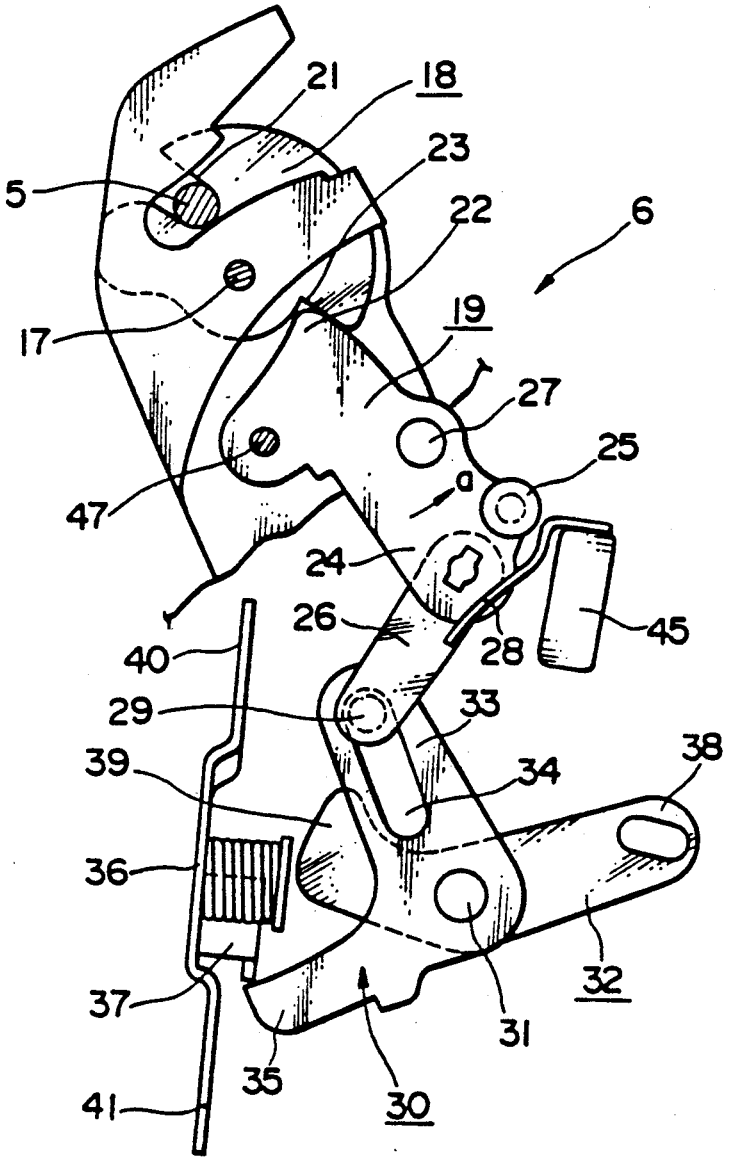
FIG. 3 is a right side view of the main lock member under a door closing state.
Figure 5:
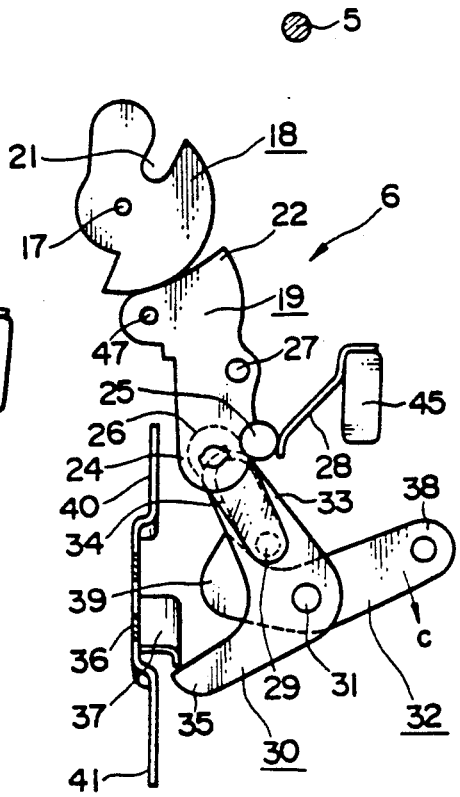
FIG. 5 is a right side view of the main lock member under a door opening state.

FIG. 3 is a right side view of the main lock member 6. An engagement groove 21 with which the main striker 5 engages and an engagement step 23 with which the pawl 22 of the ratchet 19 engages are defined around the outer periphery of the latch 18. The ratchet 19 extends downward from the horizontal shaft 47 and a contact roller 25 is disposed at the lower end 24 of the ratchet 19. A switch mechanism 45 is disposed in the proximity of the contact roller 25. A contact plate 28 of the switch mechanism 45 is out of contact from the contact roller 25 under the door closing state where the pawl 22 of the ratchet 19 engages with the step 23, but comes into contact and turns on an alarm lamp under the door opening state as shown in FIG. 5.

An engagement hole 27 is defined at an intermediate position of the ratchet 19 and the upper end of a rod or a wire (not shown) extending to the key operation portion 9 is anchored into this engagement hole 27. Therefore, when the key operation portion 9 is operated for door opening, the ratchet 19 rotates through the rod, disengages the pawl 22 from the engagement step 23 and makes it possible to open the upper door 3.

Figure 4:
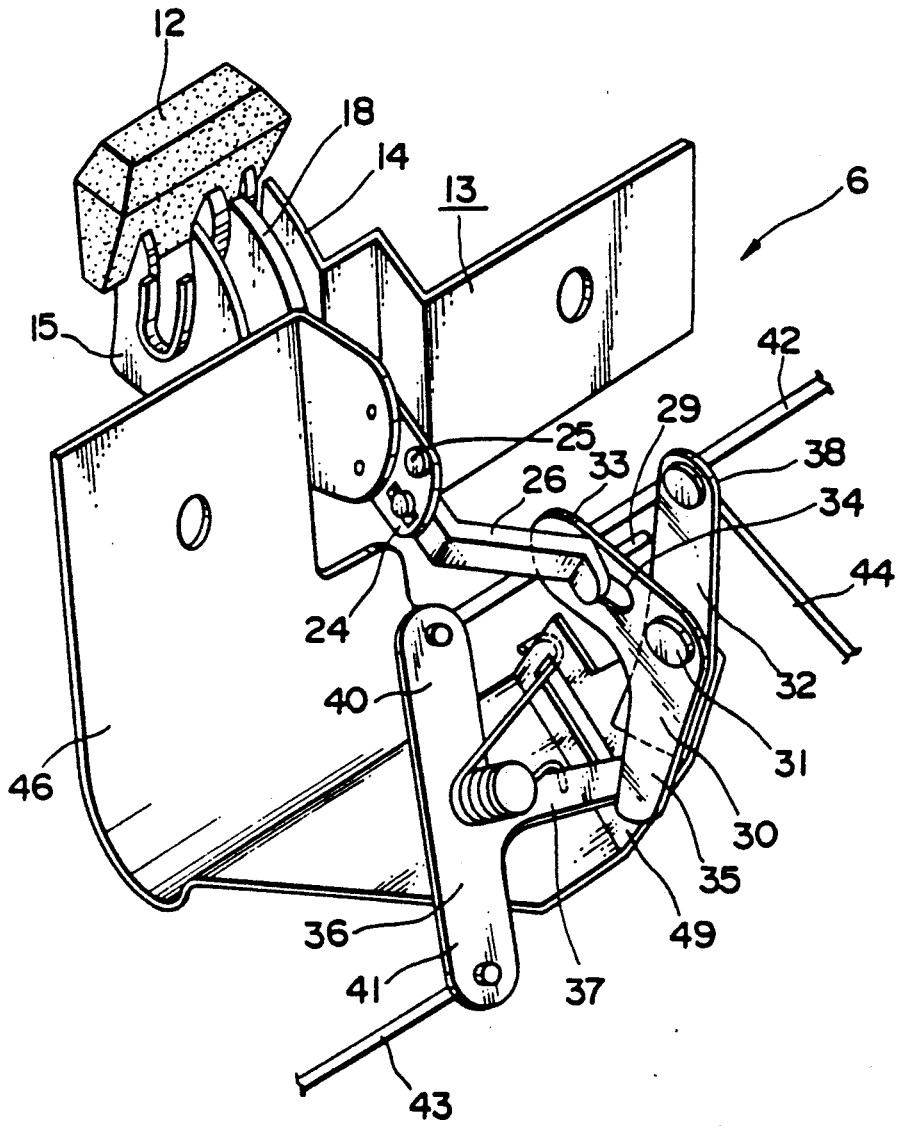
FIG. 4 is a rear perspective view of the main lock member.
Figure 6:
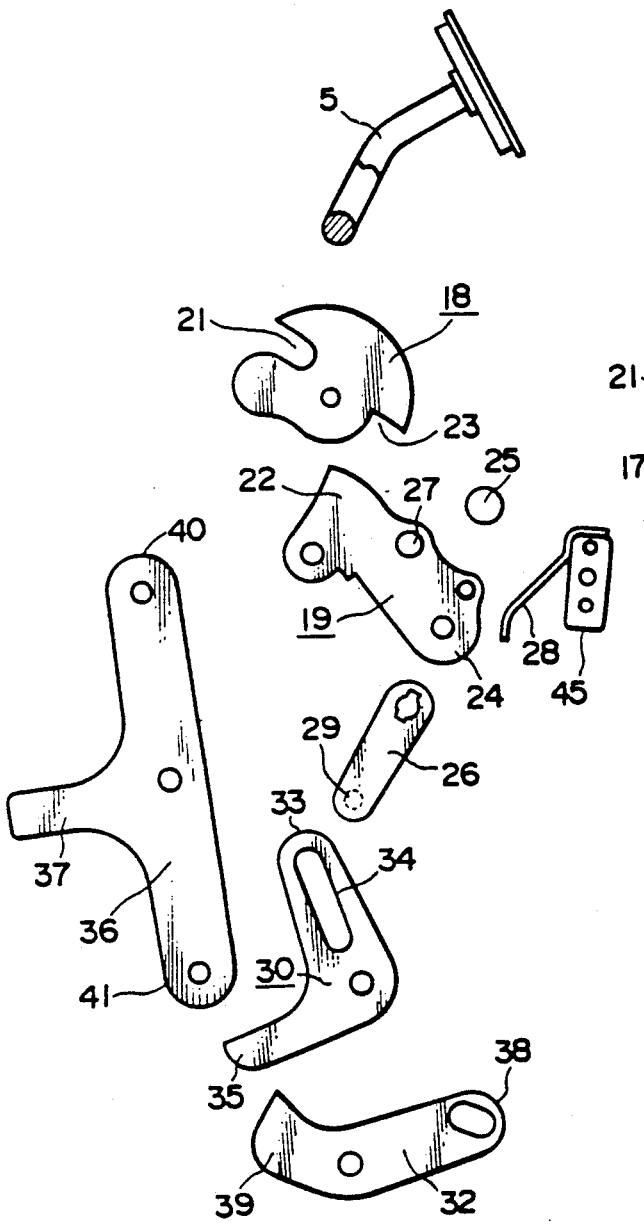
FIG. 6 is an exploded view of a striker and the main lock member.

A connecting rod 26 is rotatably fitted to the lower end 24 of the ratchet 19. A pin 29 projecting sideward is fitted to the lower end of the connecting rod 26. An L-shaped open lever 30 and an intermediate lever 32 are fitted by a shaft 31 to the rise portion 49 (see FIG. 4) of the lower metal 46. An elongated hole 34 is bored in one of the legs 33 of the open lever 30 and the pin 29 described above is fitted into this elongated hole 34. The pin 29 is positioned at the outer end of the elongated hole 34 under the door closing state (FIG. 3) and at the inner end of the elongated hole under the door opening state (FIG. 5).

A rod or a wire 44 extending to the door opening handle 8 is anchored to a plate 38 of the intermediate lever 32. When the pin 29 is at the inner end of the elongated hole 34 and the intermediate lever 32 is rotated under this state, the other plate 39 of the intermediate lever 32 engages with the pin 29 and rotates the open lever 30, but even when the intermediate lever 32 is rotated when the pin 29 is at the outer end of the elongated hole 34, the other plate 39 does not engage with the pin 29 and the open lever 30 does not rotate, either.

A rotary lever 36 is fitted rotatably to the lower metal 46. Rods 42, 43 extending to the side lock member 10 are connected to upper and lower plates 40, 41 of the rotary lever 36. A projection plate 37 engaging with the other plate 35 of the open lever 30 is formed on the rotary lever 36. Therefore, when the intermediate lever 32 is rotated while the pin 29 is positioned at the inner end of the longated hole 34, the rotary lever 36 rotates through the open lever 30 so that the side lock member 10 is opened and the lower door 4 is opened.

Next, the operation will be explained.

Under the state where the rear door 2 is closed, the side striker 11 engages with the side lock member 10, the main striker 5 engages with the engagement groove 21 of the latch 18 and the pawl 22 of the ratchet 19 engages with the engagement step 23 of the latch 18 (FIG. 3).

Even when the door opening handle 8 is operated and the intermediate lever 32 is rotated through the rod 44 under this state, the other plate 39 of the intermediate lever 32 swings wide because the pin 29 is positioned at the outer end of the elongated hole 34 of the open lever 30, so that the open lever 30 does not rotate and the lower door 4 is not opened.

When the key is fitted into the key operation portion 9 and operates the key cylinder connected to the ratchet 19 through the rod under the state shown in FIG. 3, the ratchet 19 rotates in the direction opposite a and disengages from the latch 18 so that the latch 18 is disengaged from the main striker 5 and the upper door 3 is opened.

The contact roller 25 comes into contact with the contact plate 28 due to the rotation of the ratchet 19, the switch mechanism 45 then operates to turn on the alarm lamp, the connecting rod 26 moves downward and the pin 29 descends inside the elongated hole 34 to change its position to the inner end.

When the door opening handle 8 is operated to rotate the intermediate lever 32 in the direction c through the rod 44 under this state, the other plate 39 of the intermediate lever 32 engages with the pin 29 and the open lever 30 through which the pin 29 penetrates rotates likewise in the direction c. Then, the other plate 35 of the open lever 30 engages with the projection plate 37 of the rotary lever 36 to rotate the rotary lever 36 and releases the side lock member 10 through the rods 42, 43 that are coupled to the upper and lower plates 40, 41. Accordingly, the side striker 11 is released and the lower door 4 is opened.

In the operation described above, the latch 18 of the main lock member 6 is supported by the horizontal shaft 17 which is in parallel with the transverse direction of the car body 1, and since the main striker 5 is fitted to the upper door 3 under the parallel state with the transverse direction of the car body 1, it can strongly limit the movement of the upper door 3 in both the vertical and longitudinal directions.

What is claimed is:

1. In a door device for a vehicle including:

an upper door disposed on a rear surface of a car body and fixed pivotally at an upper edge to said car body;

a lower door disposed on a rear surface of said car body and fixed pivotally at a lower edge to said car body;

a main lock member disposed at an upper edge of said lower door;

said main lock member having a spring returned latch and a spring returned ratchet for preventing the reverse rotation of said latch when said upper door is closed;

a main striker disposed at a lower edge of said upper door for engaging said main lock member;

a side lock member disposed on a right and left side of said lower door;

a side striker fixed on a right and left side of said car body for engaging said side lock member;

key operation means disposed on an outer surface of said lower door for releasing the engagement between said main lock member and said main striker thereby opening said upper door; and a door opening handle disposed on the outer surface of said lower door for releasing the engagement between said side lock members and said side striker when said upper door is open;

the improvement wherein said spring returned latch of said main lock member is rotatably fitted by a first horizontal shaft parallel to the direction of the width of said car body;

said spring returned ratchet of said main lock member is rotatably fitted by a second horizontal shaft parallel to said first shaft;

said main striker is fixed to said upper door parallel to the direction of the width of said car body; and said main lock member further comprising;

an open lever selectively engaged to said door opening handle for opening said side lock member;

an intermediate lever connected to said door opening handle;

said intermediate lever being rotatable on said open lever when said upper door is closed;

a connecting rod fixed at one end to said spring returned ratchet and slideably engaged at another end to said open lever;

said slideably engaged end of said connecting rod precluding rotation of said intermediate lever around said open lever when said upper door is open;

wherein said door opening handle can actuate said open lever and said intermediate lever to open said side lock member when said upper door is open.

2. A door lock device for a vehicle according to claim 1, wherein both of said open lever and said intermediate lever are pivotally mounted by a third horizontal shaft which is in parallel with said first horizontal shaft.

* * * * *